US006283054B1

(12) United States Patent
Engle

(10) Patent No.: US 6,283,054 B1
(45) Date of Patent: Sep. 4, 2001

(54) TEXTILE-EDGE BINDING ASSEMBLY

(75) Inventor: Elbert E. Engle, Steele, AL (US)

(73) Assignee: XYZ Control Inc., Steele, AL (US)

( * ) Notice: Subject to any disclaimer, the term of this patent is extended or adjusted under 35 U.S.C. 154(b) by 0 days.

(21) Appl. No.: 09/774,166

(22) Filed: Jan. 26, 2001

(51) Int. Cl.[7] ..... D05B 35/06; D05B 37/00
(52) U.S. Cl. ..... 112/152; 112/147; 112/137
(58) Field of Search ..... 112/470.16, 152, 112/137, 129, 147, 475.06

(56) References Cited

U.S. PATENT DOCUMENTS

| | | | | |
|---|---|---|---|---|
| 3,548,767 | * | 12/1970 | Williams | 112/152 |
| 3,664,284 | * | 5/1972 | Hester | 112/152 |
| 4,067,273 | * | 1/1978 | Marforio | 112/152 |
| 4,892,047 | * | 1/1990 | Fieschi | 112/152 |
| 4,901,657 | * | 2/1990 | Fieschi | 112/152 |
| 5,119,746 | | 6/1992 | Nishikawa et al. . | |
| 5,199,364 | * | 4/1993 | Conte et al. | 112/152 |

* cited by examiner

*Primary Examiner*—Ismael Izaguirre
(74) *Attorney, Agent, or Firm*—Christopher A. Holland; Robert J. Veal; Burr & Forman LLP

(57) ABSTRACT

A textile-edge binding assembly for applying binding tape to the edge of a textile includes a conventional sewing machine having a conventional needle and throat plate, a folding assembly, and a cutting assembly. The cutting assembly is positioned proximate the needle, and includes a first blade coupled to a second blade, with a cutting driving assembly engaging both blades. A cutting aperture traverses the first blade. The folding assembly includes a folding member, which receives and guides the binding tape to be applied to the textile. The folding member traverses the cutting aperture for application of the binding tape. A trigger is connected to the folding assembly such that the folding member can be withdrawn from the cutting assembly, and the cutting driving assembly can actuate the first and second blades to cut the binding tape. Consequently, the operator is able to provide a continuous binding tape to multiple textiles.

17 Claims, 7 Drawing Sheets

TEXTILE-EDGE BINDING ASSEMBLY

FIELD OF THE INVENTION

The present invention relates to an assembly for finishing the edge surrounding a textile material. More specifically, the present invention relates to a textile-edge binding assembly for continuously aligning and sewing an edge binding tape around the surrounding edge of a textile material.

BACKGROUND OF THE INVENTION

Various prior designs for sewing an edge binding tape around an edge of a textile article have been provided in the prior art. One example of such a design is described in U.S. Pat. No. 4,688,499 to Moore, et al., which discloses an apparatus for automatically fabricating textile articles and applying binding tape with the edge of the apparatus. The apparatus includes a guide for controlling the alignment of the binding tape with the rug, and a V-shaped cutting blade that cuts the binding tape while leaving a small center section of the binding tape uncut. The guide therefore directs application of the binding tape, and the center section of the binding tape breaks after the tape has been applied to the rug such that a leading edge of the binding tape is left in the guide for the next rug. While this design attempts to provide an efficient means for sewing the binding tape to the carpet or rug, it is subject to several problems. First, the center section of the binding tape may remain too large for trouble-free detachment from the remaining binding tape. Furthermore, the binding tape may frequently get caught in the guide during dispersion around the material, thereby causing further problems during the attachment to the material and requiring the operator to remove repair the binding tape creating the congestion in the guide.

SUMMARY OF THE INVENTION

It is an object of the present invention to provide a textile-edge binding assembly for applying a binding tape in a simple fashion for the operator.

It is a further object of the present invention to provide a textile-edge binding assembly for quick application of a binding tape around the edge of a section of a textile.

It is yet a further object of the present invention to provide a textile-edge binding assembly for applying the binding tape around the edge of a section of the textile with one continuous rotation of the textile.

It is an additional object of the present invention to provide a textile-edge binding assembly for applying a binding tape that automatically cuts the binding tape as desired by the operator.

It is yet an additional object of the present invention to provide a textile-edge binding assembly for evenly applying a binding tape to a textile in an even manner.

It is another object of the present invention to provide a textile-edge binding assembly for applying a binding tape to a textile that reduces an obstruction of binding tape in a folding member.

The present invention is for a textile-edge binding assembly that is able to apply binding tape to the edge of a desired textile, such as a bath mat, car mat, throw rug, or any other of a variety of related materials, and the design is able to apply a clean ending to the binding. The textile-edge binding assembly includes a conventional sewing machine having a conventional needle and throat plate, a folding assembly, and a cutting assembly. The folding assembly and cutting assembly are positioned proximate the needle for application and trimming of the binding tape. The folding assembly includes a folding member, which receives and guides the binding tape to be applied to the textile. The folding member slidingly traverses the cutting assembly for application of the binding tape to the textile, such that the folding member can be withdrawn from the cutting assembly when the binding tape is to be cut. As a result, the operator is able to provide a continuous binding tape to each textile, and the binding tape additionally remains appropriately positioned in the folding member for simple application of the binding tape to multiple textiles by the operator.

These and other objects, features, aspects and advantages of the present invention will become more apparent from the following detailed description of the present invention when taken in conjunction with the accompanying drawings.

BRIEF DESCRIPTION OF THE DRAWINGS

A textile-edge binding assembly incorporating the features of the present invention is depicted in the accompanying drawings which form portion of this disclosure and wherein.

DESCRIPTION OF THE PREFERRED EMBODIMENT

Figure 1:
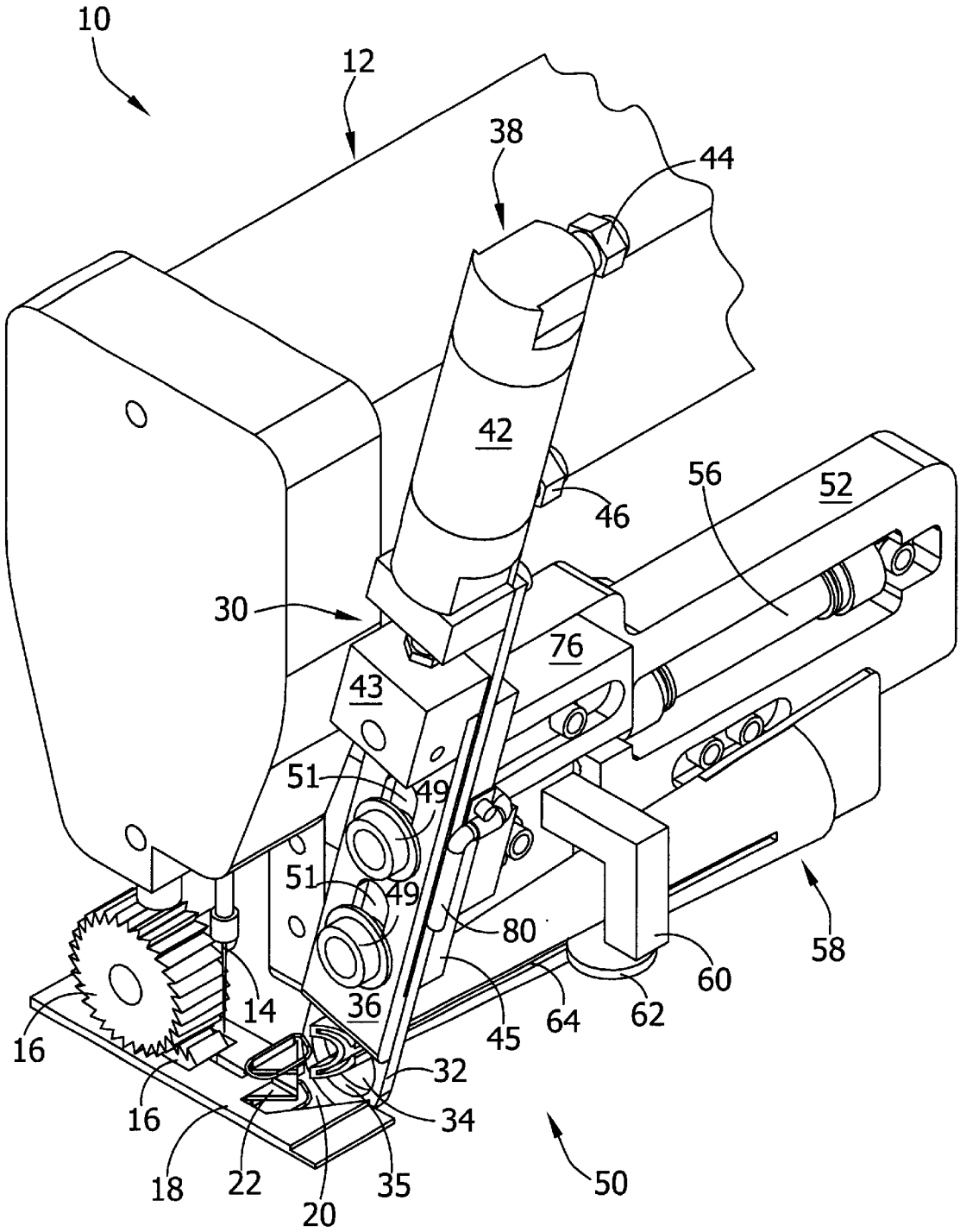
FIG. 1 is a perspective view of a textile-edge binding assembly of the present invention, the present view illustrating a folder assembly in an extended position.
Figure 2:
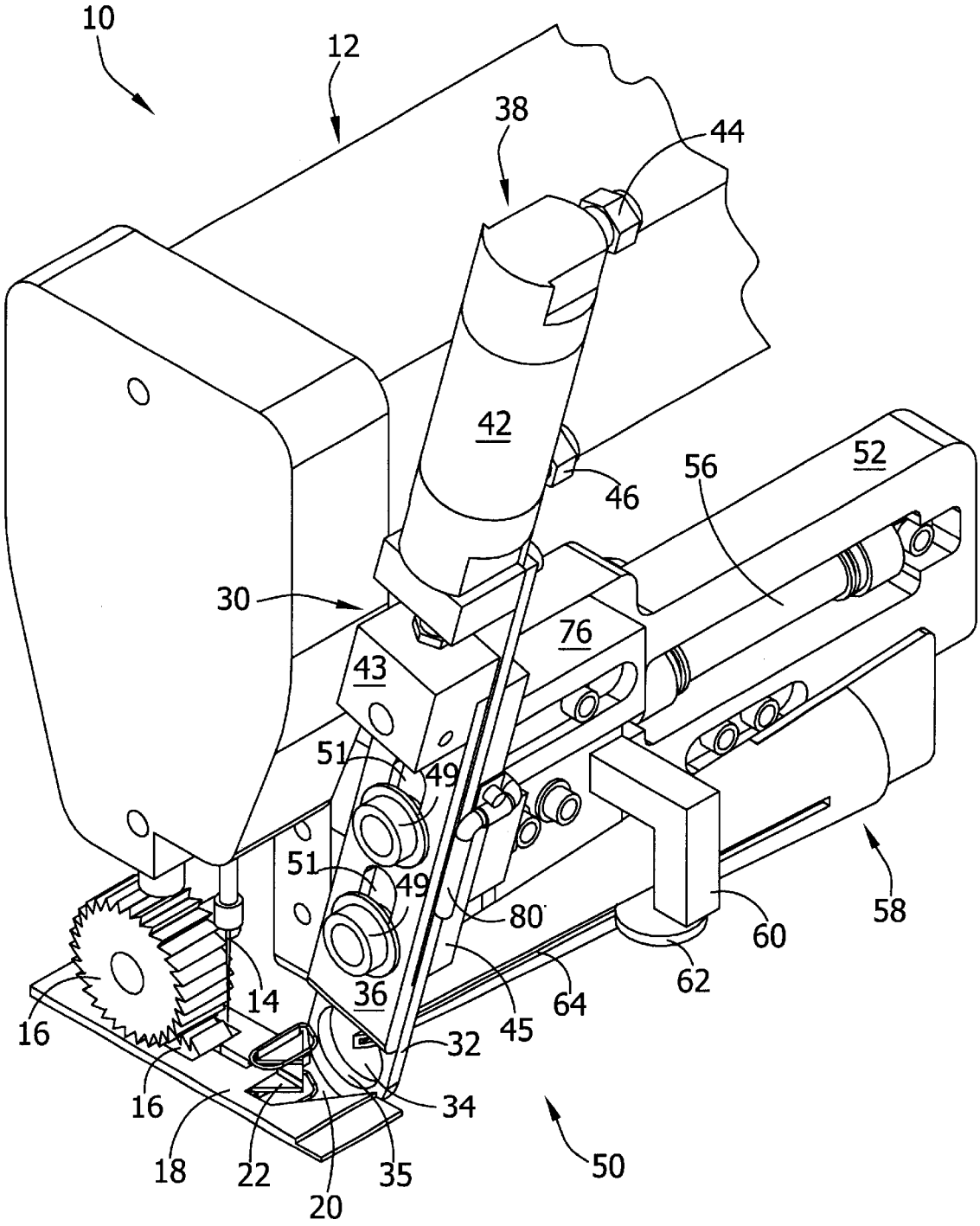
FIG. 2 is a perspective view of the textile-edge binding assembly of the present invention as illustrated in FIG. 1, the present view illustrating the folder assembly in a retracted position.
Figure 3:
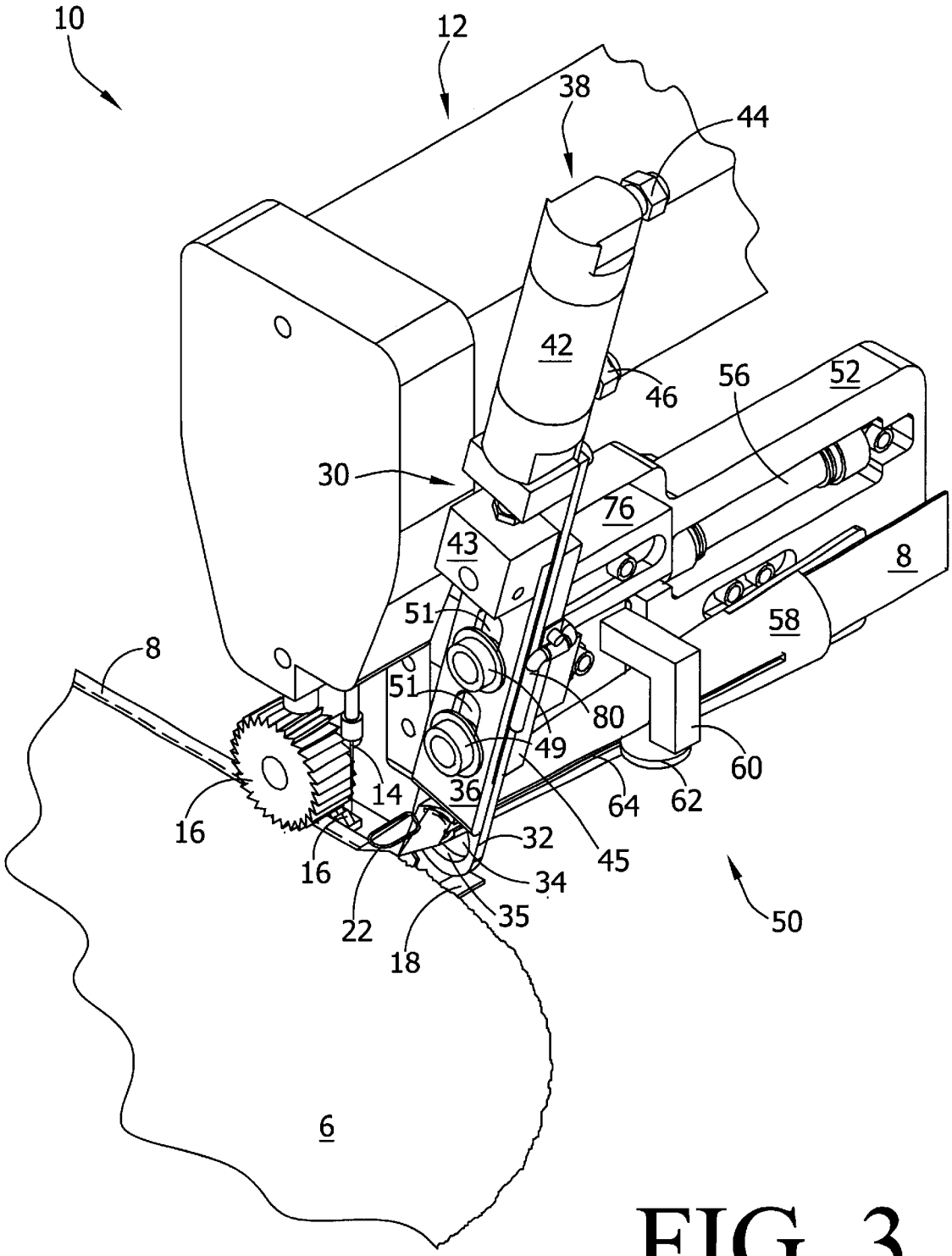
FIG. 3 is a perspective view of the textile-edge binding assembly as illustrated in FIG. 1, with the present view including a binding being applied to a textile.

Looking now to FIGS. 1 through 3, the preferred embodiment of a textile-edge binding assembly 10 of the present invention is illustrated, wherein the textile-edge binding assembly 10 is operable to apply a binding tape 8 to the edge of a textile 6. The textileedge binding assembly 10 includes a conventional sewing machine 12, a cutting assembly 30 and a folding assembly 50. The cutting assembly 30 and the folding assembly 50 are integrally connected to the sewing machine 12. The sewing machine 12 used in the present invention can be any one of various sewing machine designs that are known in the art. In the preferred embodiment, the sewing machine 12 is one having a motor driven sewing needle 14 and a pair of motor-driven engagement rollers 16*a*, 16*b*, with a throat plate 18 positioned between the engagement rollers 16*a*, 16*b*. The throat plate 18 is designed to support the textile 6, and includes a groove 20 through which a textile guide 22 is preferably positioned. The textile guide 22 serves to engage the textile 6 to steady and position the textile 6 while the engagement rollers 16*a*, 16*b* further draw the textile 6 toward the sewing needle 14. The sewing needle 14 subsequently sews the binding tape 8 to the edge of the textile 6. Moreover, it should be noted that the binding tape 8 used in the present invention can be any type of material having the aesthetic and strength properties desired by the operator, such as a woven material, cotton material, or synthetic material.

The textile-edge binding assembly 10 includes a cutting assembly 30 that is angularly mounted proximate the sewing needle 14 (see FIG. 1). Looking at FIGS. 4 and 5, the cutting assembly 30 includes a first cutting blade 32 having a cutting aperture 34 that defines a first cutting edge 35, and a second cutting blade 36 having a second cutting edge 37, wherein the second cutting blade 36 is detachably coupled to the first cutting blade 32 proximate the cutting aperture 34. The first and second cutting blades 32, 36 are further connected to a blade driving assembly such that the first cutting blade 32 is slidingly related to the second cutting blade 36. The blade driving assembly preferably includes a cutting pneumatic cylinder 38, with the cutting pneumatic cylinder 38 actuating movement between the first and second cutting blades 32, 36, as described further herein. While the blade driving assembly is preferably in the embodiment of a pneumatic cylinder, other embodiments, such as an electric motor or a hydraulic cylinder, be employed in the present invention as well to achieve the desired results. The cutting pneumatic cylinder 38 of the preferred embodiment includes a cylinder housing 42 that partially encloses a piston 47, with a pair of pneumatic connectors 44, 46 additionally connected to the cylinder housing 42. The pneumatic connectors 44, 46 act as a triggering means to control the extension and retraction of the piston 47 from within the cylinder housing 42 as desired by the operator.

Figure 4:
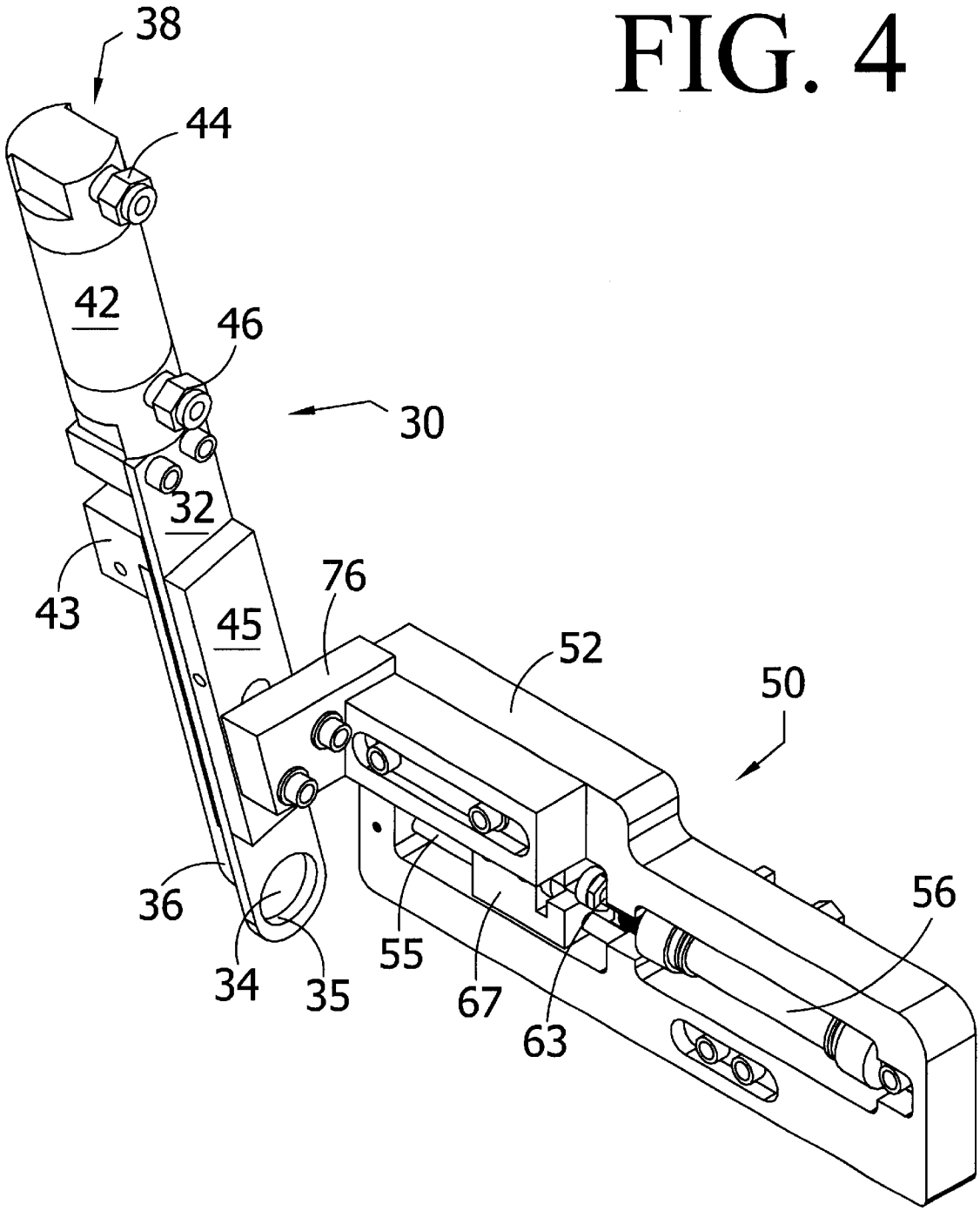
FIG. 4 is a front perspective view of the cutting assembly and the folding assembly of textile-edge binding assembly.
Figure 5:
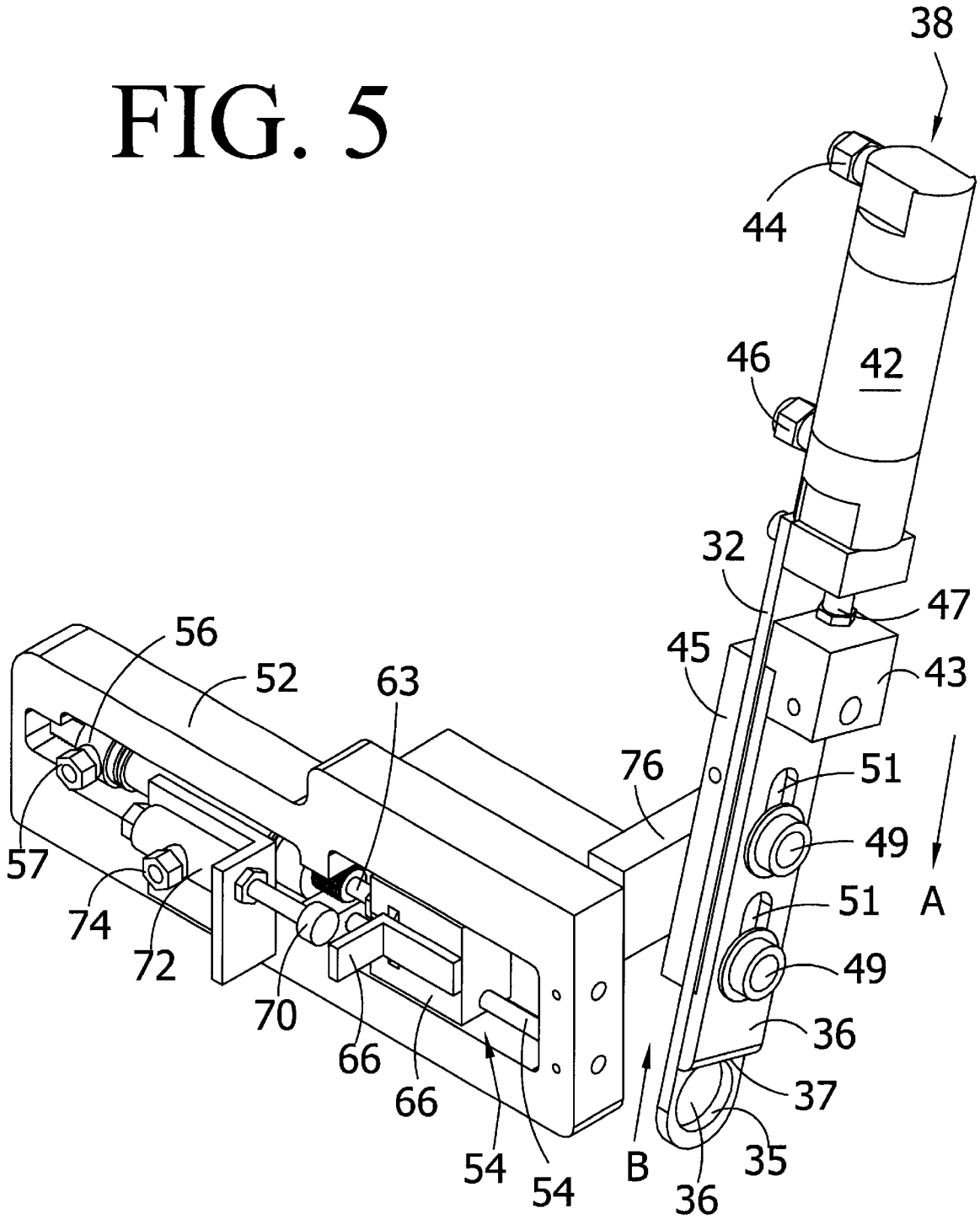
FIG. 5 is a rear perspective view of the cutting assembly and the folding assembly of the textile-edge binding assembly.

Looking further at FIGS. 1, 4, and 5, the cutting assembly 30 further includes a base plate 45 and a pair of blade shafts 49. A pair of shaft apertures 51, preferably ovular in shape, traverse the second cutting blade 36, and each blade shaft 49 traverses one shaft aperture 51 to couple the base plate 45 with the first and second cutting blades 32, 36. Moreover, a connecting block 43 is positioned between the second cutting blade 36 and the piston 47. It should be noted that while the second cutting blade 36 is connected to the piston 47, the first cutting blade 32 is connected to the cylinder housing 42. As a result of this arrangement, when the cutting pneumatic cylinder 38 is actuated and the piston 47 is extended away from the cylinder housing 42, the second cutting blade 36 will be driven in a first direction A, while the first cutting blade 32 will be driven in an opposing direction B, as illustrated in FIG. 5, the application of which is described herein.

Figure 6:
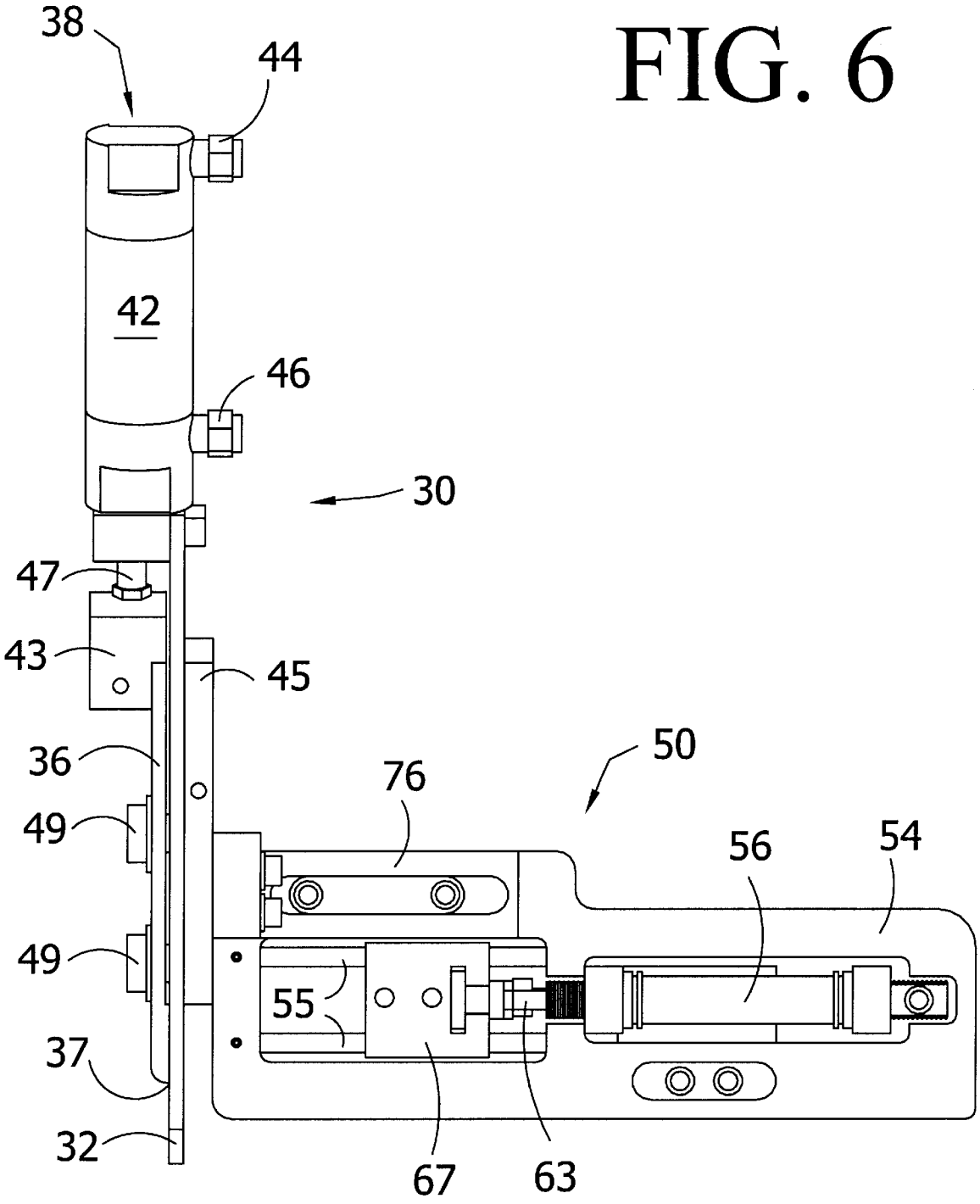
FIG. 6 is a front elevational view of the cutting assembly and the folding assembly of the textile-edge binding assembly.
Figure 7:
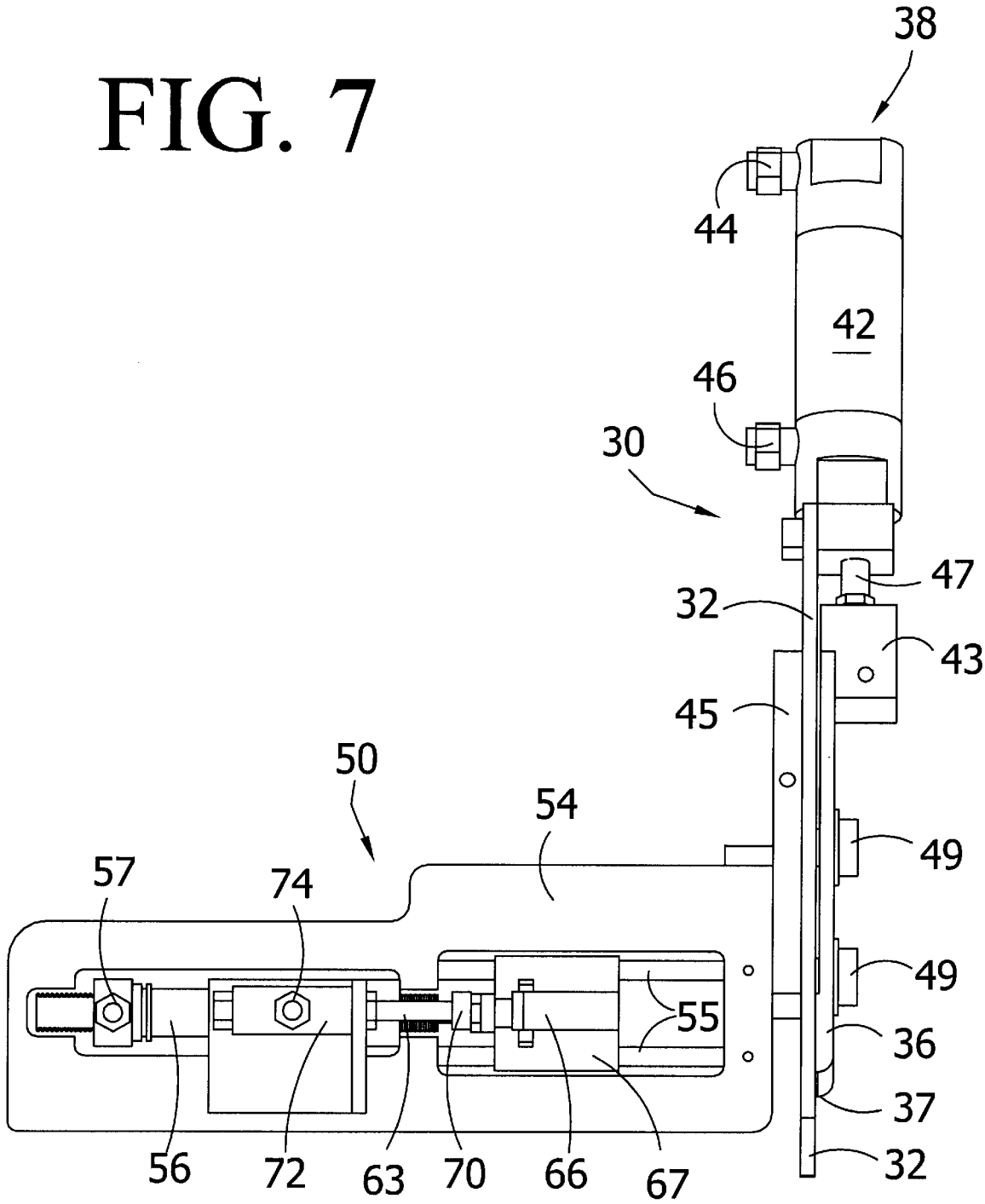
FIG. 7 is a rear elevational view of the cutting assembly and the folding assembly of the textile-edge binding assembly.

As stated above, the textile-edge binding assembly 10 includes a folding assembly 50 in addition to the cutting assembly 30. The folding assembly 50 operates to fold and position the binding tape 8 so that the binding tape 8 can be accurately attached to the edge of the textile 6 (see FIG. 3). Looking at FIGS. 4–7, the folding assembly 50 includes a housing 52, with a folder driving assembly 54 attached thereto. The folder driving assembly 54 preferably includes a folding pneumatic cylinder 56 that is mounted within the housing 52. The pneumatic cylinder 56 includes a piston 63, and the piston 63 is further connected to a folder-guiding block 67 that is supported by a pair of block shafts 55 (see FIGS. 6 and 7). A folding member 58 (illustrated in FIG. 1), preferably having a substantially frustoconical shape, is attached to the folder-guiding block 67, such that the folding pneumatic cylinder 56 will cause a lateral movement of the folder-guiding block 67 and folding member 58 between an extended position (see FIG. 1) and a retracted position (see FIG. 2). The folding member 58 is additionally coupled to the housing 52 via an L-shaped positioning arm 60 and guiding disc 62. A positioning channel 64 extends along one side of the folding member 58, and the guiding disc 62 engages said positioning channel 64 such that level movement of the folding member 58 will be directed by the relationship of the guiding disc 62 with the positioning channel 64.

Referring again to FIGS. 1 through 3, the folding assembly 50 is illustrated as cooperatively operating with the cutting assembly 30. As stated above, the folding member 58 moves between the extended position and the retracted position. In the extended position, the folding member 58 passes through the cutting aperture 36 of the first cutting member 34 while binding tape 8 is being applied to the textile 6. The folding member 58 is used to receive the binding tape 8 and couple the binding tape 8 around the edge of the textile 6. As the sewing machine 12 draws the textile 6 with the engagement rollers 16*a*, 16*b*, the needle 14 will sew the binding tape 8 to the textile 6 and the binding tape 8 will continue to be drawn through the folding member 58. Once the operator has applied the binding tape 8 to a substantial portion of the edge of the textile 6, the operator will then engage an actuating switch (not illustrated), which is preferably activated by the operator's foot or leg. The actuating switch, which is preferably connected to folding pneumatic cylinder 56 via pneumatic connectors 57*a*, 57*b*, will consequently actuate the folding pneumatic cylinder 56 such that the piston 65 of the folding pneumatic cylinder 56 will be retracted. The piston 65, which is connected to the folder-guiding block 67, is retracted, and the folding member 58 will also be moved away from the cutting assembly 30 as well. As a result, the folding member 58 will no longer traverse the cutting aperture 34 (see FIG. 2), although the binding tape 8 will still pass through the cutting aperture 34 to engage the textile 8.

In the retracted position, the folding member 58 does not traverse the cutting aperture 34, and the cutting assembly 30 may be actuated to cut the binding tape 8. More specifically, an L-shaped trigger switch 66 is attached to the folder-guiding block 67. A connecting pneumatic cylinder 72 is positioned proximate the folder-guiding block 67, such that a connecting switch 70 is proximate the L-shaped trigger switch 66. Consequently, when the folder-guiding block 67 is retracted, the L-shaped trigger switch 66 will engage the connecting switch 70 is engaged. The connecting pneumatic cylinder 72, which is connected to the cutting pneumatic cylinder 38 via connecting switches, such as pneumatic connector 74 and pneumatic connector 44, will thereby activate the cutting assembly 30.

Activation of the cutting assembly 30 will result in the binding tape 8 being severed by the first and second cutting blades 32, 36. In operation, the cutting pneumatic cylinder 38 is actuated such that the piston 47 is thrust from the cylinder housing 42. The thrust of the piston 47 will concomitantly propel the connecting block 43 and second cutting blade 36 toward the binding tape 8 in direction A, while concurrently drawing the first cutting blade 32 in an opposing direction B, as illustrated in FIG. 5. Consequently, the binding tape 8 will be engaged by the cutting edge 35 of the first cutting blade 32 and the cutting edge 37 of the second cutting blade 36 such that the rendezvous between the cutting edges 35, 37 will slice the binding tape 8 as desired by the operator. The cutting action of the cutting assembly 30 is such that the both the cutting edge 35 and the second cutting blade 36 are actively moving toward the binding tape 8, which therefore provides the desired even cut in the binding tape 8 to aid the user in the application of the binding tape 8 to the textile. Therefore, the first cutting blade 32 and the second cutting blade 36 will make an incision in the binding in the middle of a fold of the binding tape 8, which will help to prevent distortion of the binding tape 8 as applied to the textile 6.

Once the binding tape 8 has been cut, the operator will then release the actuating switch, such that the piston 47 is retracted into the cylinder housing 42 and the first and second cutting blades 32, 36 are returned to the original position. The folding piston 63 of the folding pneumatic cylinder 56 is then once again extended, such that folder-guiding block 67, and consequently the folder member 58, are moved toward the cutting assembly 30. The folder member 58 will once again traverse the cutting aperture 34, such that folding member 58 will be ready to direct the application of the binding 8 onto the next textile 6.

The present invention may additionally include a blower member 80 attached proximate the junction of the cutting assembly 30 and the folding assembly 50, as illustrated in FIGS. 1 and 2. The blower member 80 provides a simple mechanism for applying a moderate air force toward the junction of the binding tape 8 from the folding assembly 50, such that the force of air will propel undesired remnants from the sewing machine 12 after the binding tape 8 has been cut by the cutting assembly 30. Such an embodiment reduces the potential for having undesired elements accumulate on the throat plate 18 or being attached to the textile 6.

Thus, although there have been described particular embodiments of the present invention of a new and useful TEXTILE-EDGE BINDING ASSEMBLY, it is not intended that such references be construed as limitations upon the scope of this invention except as set forth in the following claims.

What is claimed is:

1. A textile-edge binding assembly for sewing a binding tape to the edge of a textile comprising:

a sewing machine including a sewing needle and a throat plate;

a cutting assembly connected to said sewing machine proximate said sewing needle;

a folding assembly slidingly connected to said sewing machine proximate said sewing needle, said folding assembly positionable between an extended position such that said folding assembly traverses said cutting assembly and a retracted position such that said folding assembly is distanced from said cutting assembly; and a triggering means for controlling the movement of said folding assembly between said extended position and said retracted position, said triggering means connected to said folding assembly.

2. The textile-edge binding assembly as described in claim 1 wherein said cutting assembly comprises:

a first cutting blade with a cutting aperture traversing said first cutting blade, said cutting aperture defining a first cutting edge;

a second cutting blade slidingly coupled to said first cutting blade, said secodn cutting blade defining a second cutting edge; and a blade driving assembly connected to said first cutting blade and said second cutting blade;

wherein said blade driving assembly concomitantly urges said first cutting blade and said second cutting blade such that said first cutting edge moves toward said second cutting edge and said second cutting edge moves toward said first cutting edge.

3. The textile-edge binding assembly as described in claim 2 wherein said blade driving assembly comprises a pneumatic cylinder having a cylinder housing attached to said first cutting blade and a piston connected to said second cutting blade.

4. The textile-edge binding assembly as described in claim 1 wherein said folding assembly comprises:

a folder member housing connected to said sewing machine;

a folder driving assembly mounted in said folder member housing; and a folder member connected to said folder driving assembly such that said folder driving assembly moves said folder member between said extended and said retracted position, wherein the binding tape traverses said folding member such that said folding member folds the binding tape.

5. The textile-edge binding assembly as described in claim 4 wherein said folding member is substantially frustoconical.

6. The textile-edge binding assembly as described in claim 4 wherein said folder driving assembly comprises a pneumatic cylinder and a folder-guiding block mounted in said folder member housing, said pneumatic cylinder having a cylinder housing and a piston, said piston connected to said folder-guiding block to direct the movement of said folder-guiding block, and said folder-guiding block connected to said folder member.

7. The textile-edge binding assembly as described in claim 1 further comprising a blower mounted proximate said cutting aperture of said first cutting blade such that said blower provides an air force toward the binding tape traversing said cutting aperture.

8. The textile-edge binding assembly as described in claim 1 further comprising a connecting switch coupling said folding assembly with said cutting assembly, wherein said folding assembly activates said connecting switch when said folding assembly is in said retracted position such that said cutting assembly is actuated to cut the binding tape.

9. In combination with a sewing machine assembly having a sewing needle for sewing a binding tape to an edge of a textile, wherein the improvement comprises:

a cutting assembly connected to the sewing machine proximate the sewing needle;

a folding assembly slidingly connected to the sewing machine proximate said sewing needle, said folding assembly positionable between an extended position such that said folding assembly traverses said cutting assembly and a retracted position such that said folding assembly is distanced from said cutting assembly; and a trigger connected to said folding assembly, said trigger controlling the movement of said folding assembly between said extended position and said retracted position.

10. The combination as described in claim 9, wherein said cutting assembly further comprises:

a first blade having a cutting aperture traversing therethrough, said cutting aperture defining a first cutting edge;

a second blade slidably coupled to said first blade, said second blade having a second cutting edge; and a blade driving assembly connected to said first blade and said second blade, said blade driving assembly concomitantly compelling said first cutting edge and said second cutting edge toward each other.

11. The combination as described in claim 10 wherein said blade driving assembly further comprises a pneumatic cylinder having a cylinder housing and a piston, said cylinder housing being connected to said first cutting blade and said piston being connected to said second cutting blade.

12. The combination as described in claim 9 wherein said folding assembly further comprises:

a folder member housing connected to said sewing machine;

a folder driving assembly mounted in said folder member housing; and a folder member connected to said folder driving assembly such that said folder driving assembly moves said folder member between said extended and said retracted position, wherein the binding tape traverses said folding member such that said folding member positions and folds the binding tape.

13. The combination as described in claim 12 wherein said folding member is substantially frustoconical.

14. The combination as described in claim 12 wherein said folder driving assembly comprises a pneumatic cylinder and a folder-guiding block mounted in said folder member housing, said pneumatic cylinder having a cylinder housing and a piston, said piston connected to said folder-guiding block to direct the movement of said folder-guiding block, and said folder-guiding block connected to said folder member.

15. The combination as described in claim 9 further comprising a blower mounted proximate said cutting aperture of said first cutting blade such that said blower provides an air force toward the binding tape traversing said cutting aperture.

16. A method for cutting binding tape as the binding tape is being sewn onto a textile using a sewing machine, said method comprising the steps of:

a) providing a cutting assembly connected to the sewing machine, said cutting assembly including a first cutting blade with a cutting aperture traversing therethrough and a second cutting blade coupled to said first cutting blade;

b) providing a folding assembly connected to the sewing machine and coupled to said cutting assembly by a connecting switch, wherein said folding assembly traverses said cutting aperture and folds the binding tape to engage the textile;

c) engaging a trigger connected to said folding assembly to retract said folding assembly from said cutting assembly;

d) contacting said connecting switch with the retraction of said folding assembly;

e) actuating said cutting assembly with said connecting switch such that first cutting blade and said second cutting blade travel in opposing directions; and f) cutting the binding tape with said cutting assembly.

17. The method as described in claim 16, wherein step (f) comprises:

providing a first blade having a cutting aperture, said cutting aperture defining a first cutting edge;

providing a second blade coupled to said first blade, said second blade defining a second cutting edge;

providing a blade driving assembly connected to said first and second blades;

moving said first cutting edge of said first blade toward said second cutting edge of said second blade with said blade driving assembly;

moving said second cutting edge of said second blade toward said first cutting edge of said first blade with said blade driving assembly; and slicing said binding tape between said first cutting edge and said second cutting edge.

* * * * *